US009666164B2

(12) United States Patent
Park et al.

(10) Patent No.: US 9,666,164 B2
(45) Date of Patent: May 30, 2017

(54) IMAGE PROCESSING APPARATUS AND IMAGE PROCESSING METHOD

(71) Applicant: SAMSUNG DISPLAY CO., LTD., Yongin, Gyeonggi-Do (KR)

(72) Inventors: Ji-Eun Park, Yongin (KR); Hee-Chul Whang, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 22 days.

(21) Appl. No.: 14/597,208

(22) Filed: Jan. 14, 2015

(65) Prior Publication Data

US 2015/0243260 A1 Aug. 27, 2015

(30) Foreign Application Priority Data

Feb. 24, 2014 (KR) ..... 10-2014-0021337

(51) Int. Cl.

*G09G 5/00* (2006.01)
*G09G 5/02* (2006.01)
*G09G 3/20* (2006.01)

(52) U.S. Cl.

CPC ..... *G09G 5/026* (2013.01); *G09G 3/20* (2013.01); *G09G 2340/0407* (2013.01); *G09G 2340/10* (2013.01); *G09G 2340/14* (2013.01)

(58) Field of Classification Search

USPC ..... 345/207, 204, 213, 598, 660, 592, 690, 345/611, 411, 581, 619, 688; 358/1.9; 382/149; 600/109

See application file for complete search history.

(56) References Cited

U.S. PATENT DOCUMENTS 6,492,982 B1 * 12/2002 Matsuzaki ..... G09G 5/006 345/204
6,504,310 B2 * 1/2003 Naka ..... G09G 3/2022 315/169.1
7,202,876 B2 * 4/2007 Fushiki ..... G06T 9/005 345/592
8,441,539 B2 * 5/2013 Tokui ..... H04N 5/23248 348/208.4
8,526,061 B2 * 9/2013 Shirata ..... H04N 1/40062 345/592

(Continued)

FOREIGN PATENT DOCUMENTS

KR 10-2004-0062297 A 7/2004
KR 10-2004-0086553 A 10/2004

(Continued)

*Primary Examiner* — Thuy Pardo

(74) *Attorney, Agent, or Firm* — Lewis Roca Rothgerber Christie LLP

(57) ABSTRACT

An image processing apparatus includes: a pattern identification unit configured to perform pattern identification for first image data; a first data conversion unit configured to perform first data conversion for the first image data, after a pattern of the first image data is identified, to generate second image data; a second data conversion unit configured to perform second data conversion for the second image data to generate third image data; and a process selection unit configured to determine whether or not to perform at least one of the pattern identification, the first data conversion, or the second data conversion according to a measured value that is input from an outside or an on/off state of a call mode.

17 Claims, 3 Drawing Sheets

(56) References Cited

U.S. PATENT DOCUMENTS

| | | | | |
|---|---|---|---|---|
| 2001/0040588 | A1* | 11/2001 | Shiraiwa | H04N 1/6088 345/690 |
| 2003/0107583 | A1* | 6/2003 | Fushiki | G06T 9/005 345/611 |
| 2004/0135926 | A1 | 7/2004 | Song et al. | |
| 2004/0246374 | A1 | 12/2004 | Mishima et al. | |
| 2005/0140679 | A1* | 6/2005 | Kaneda | G06K 9/4647 345/441 |
| 2005/0231740 | A1* | 10/2005 | Uchino | H04N 1/6086 358/1.9 |
| 2006/0083420 | A1* | 4/2006 | Kawaguchi | G01N 21/956 382/149 |
| 2009/0316050 | A1 | 12/2009 | Sahu et al. | |
| 2010/0026722 | A1* | 2/2010 | Kondo | G09G 3/2007 345/660 |
| 2011/0063460 | A1* | 3/2011 | Tokui | H04N 5/23248 348/208.4 |
| 2011/0157474 | A1* | 6/2011 | Nagata | H04N 5/445 348/598 |
| 2014/0228638 | A1* | 8/2014 | Ashida | A61B 1/00009 600/109 |

FOREIGN PATENT DOCUMENTS

| | | | |
|---|---|---|---|
| KR | 10-2006-0135365 | A | 12/2006 |
| KR | 10-2008-0010007 | A | 1/2008 |
| KR | 10-2011-0031162 | A | 3/2011 |

* cited by examiner

IMAGE PROCESSING APPARATUS AND IMAGE PROCESSING METHOD

CROSS-REFERENCE TO RELATED APPLICATION

This application claims priority to and the benefit of Korean Patent Application No. 10-2014-0021337, filed on Feb. 24, 2014, in the Korean Intellectual Property Office, the entire contents of which are incorporated herein by reference in their entirety.

BACKGROUND

1. Field

Aspects of example embodiments of the present invention relate to an image processing apparatus and an image processing method.

2. Description of the Related Art

An image processing apparatus may include various image processing circuits for processing supplied image data for displaying an image on a display panel. The display panel may be implemented as a liquid crystal display (LCD) or an organic light emitting display (OLED).

An image processing apparatus may include an up-scaler configured to vary the resolution of the image data that is input from an external source. For example, when the resolution of the display panel is higher than that of the input image data, an image processing apparatus may utilize up-scale technology to interpolate the image data and generate a median value.

An up-scaler may be implemented in various manners, and various methods such as edge compensation and character pattern recognition have been proposed to create a high-quality image in view of sharpness or the like.

SUMMARY

According to example embodiments of the present invention, an image processing apparatus includes: a pattern identification unit configured to perform pattern identification for first image data; a first data conversion unit configured to perform first data conversion for the first image data, after a pattern of the first image data is identified, to generate second image data; a second data conversion unit configured to perform second data conversion for the second image data to generate third image data; and a process selection unit configured to determine whether or not to perform at least one of the pattern identification, the first data conversion, or the second data conversion according to a measured value that is input from an outside or an on/off state of a call mode.

The second image data may have a higher resolution than that of the first image data.

The first data conversion unit may include a first interpolation unit configured to interpolate the first image data having a first resolution to generate the second image data having a second resolution that is higher than the first resolution.

The third image data may have a higher sharpness than that of the second image data.

The measured value may include at least one of an illumination measuring value sensed by an illumination sensor, or an acceleration measuring value sensed by an acceleration sensor.

The process selection unit may be configured to output a process control signal to perform only the first data conversion, when the illumination measuring value is more than a first reference value.

The process selection unit may be configured to output the process control signal to perform only the pattern identification and the first data conversion, when the acceleration measuring value is more than a second reference value.

The process selection unit may be configured to analyze the measured value frame by frame and then output a process control signal.

The pattern identification unit may include: a first pattern identification unit configured to identify an edge pattern from the first image data; and a second pattern identification unit configured to identify a character pattern.

The first data conversion unit may include: first and second interpolation units configured to perform the first data conversion according to the edge pattern and the character pattern, respectively.

The second data conversion unit may include: first and second enhancement units configured to perform the second data conversion according to the edge pattern and the character pattern, respectively.

The process selection unit may be configured to output a process control signal to perform the first data conversion and the second data conversion corresponding to the character pattern, when the call mode is on.

According to example embodiments of the present invention, an image processing method includes: determining, according to a measured value input from an outside or an on/off state of a call mode, whether or not to perform at least one of: identifying a pattern for first image data; generating second image data by performing first data conversion for the first image data after the pattern for the first image data has been identified; or generating third image data by performing second data conversion for the second image data The measured value may include at least one of an illumination measuring value sensed by an illumination sensor, or an acceleration measuring value sensed by an acceleration sensor.

The method may further include determining whether or not to perform only the generating of the second image data, when the illumination measuring value is more than a first reference value.

The method may further include determining whether or not to perform only the identifying of the pattern and the generating of the second image data, when the acceleration measuring value is more than a second reference value.

The method may further include determining whether or not to perform the identifying of the pattern, the generating of the second image data, and the generating of the third image data, when the call mode is on.

The method may further include analyzing the measured value frame by frame.

BRIEF DESCRIPTION OF THE DRAWINGS

Aspects of example embodiments will now be described more fully hereinafter with reference to the accompanying drawings; however, they may be embodied in different forms and should not be construed as limited to the embodiments set forth herein. Rather, these embodiments are provided so that this disclosure will be more thorough and more complete, and will more fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Hereinafter, aspects of example embodiments of the present invention will be described in some detail with reference to the accompanying drawings.

Figure 1:
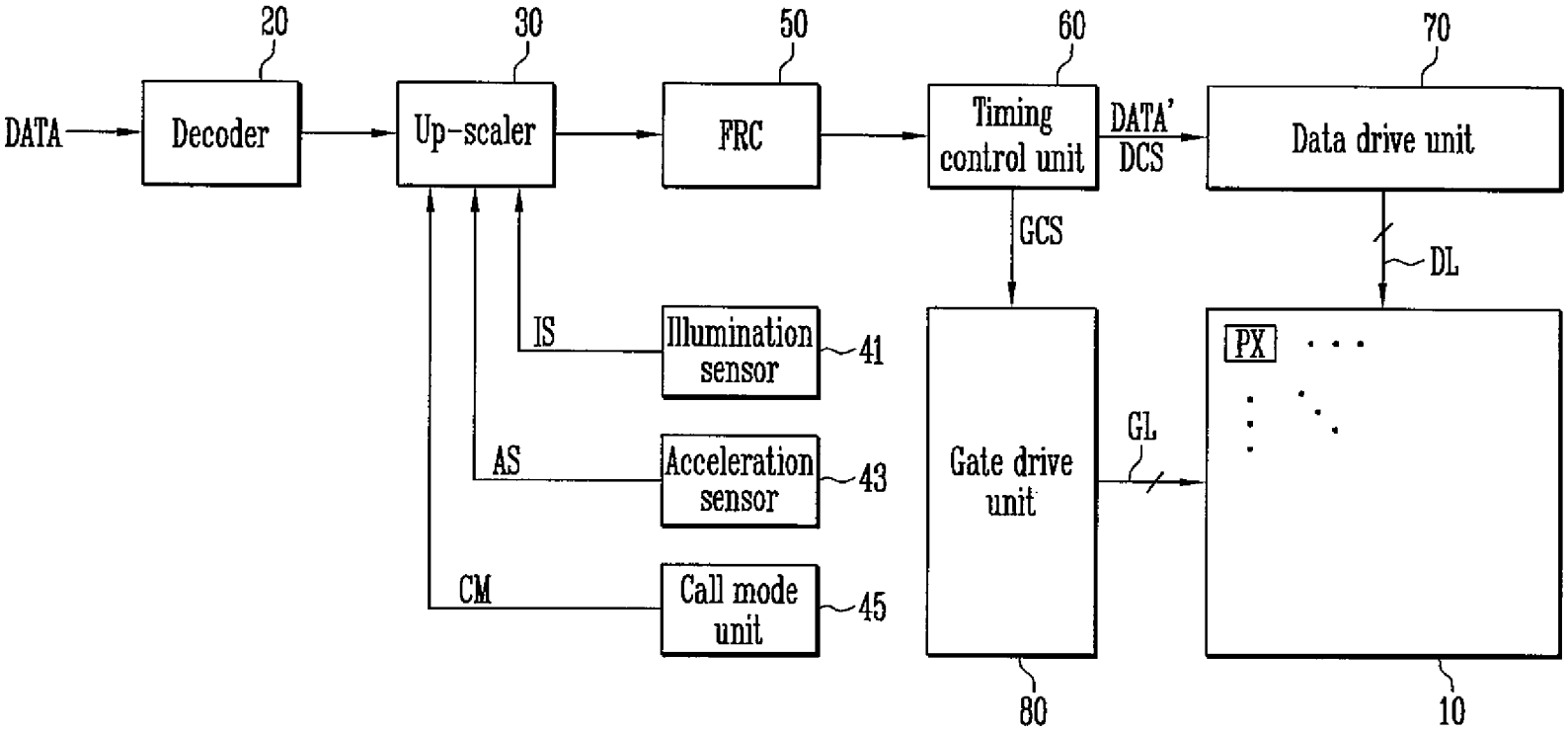
FIG. 1 is a view schematically showing a configuration of an image processing apparatus according to embodiments of the present invention.

FIG. 1 is a view schematically showing the configuration of an image processing apparatus according to embodiments of the present invention.

Referring to FIG. 1, the image processing apparatus may include a display panel 10, a decoder 20, an up-scaler 30, an illumination sensor 41, an acceleration sensor 43, a call mode unit 45, a frame rate control (FRC) 50, a timing control unit 60, a data drive unit 70, and a gate drive unit 80.

Although the image processing apparatus of this embodiment is illustrated with an image processing apparatus of a mobile terminal, which is provided with the illumination sensor 41 and the acceleration sensor 43 and has a call function, the present invention is not limited thereto.

The display panel 10 includes a plurality of gate lines GL, which are formed in a row direction to transmit a gate signal, a plurality of data lines DL, which are formed in a column direction to transmit a data signal, and a plurality of pixels PX, which are coupled to the gate lines GL and the data lines DL and are arranged in a matrix form.

In some embodiments, the display panel 10 is a LCD display panel. The pixels PX include a thin film transistor that is electrically coupled to the gate lines GL and the data lines DL, and a pixel electrode that is coupled to the thin film transistor. The thin film transistor is controlled to be on or off in response to the gate signal applied from the gate lines GL, and receives the data signal applied by the data lines DL and then transmits the data signal to the pixel electrode, thus controlling the displacement of a liquid crystal molecule and thereby displaying an image.

In other embodiments, the display panel 10 is an OLED panel. The pixels PX may include an organic light emitting diode that is supplied with first power ELVDD and second power ELVSS and emits light with a luminance corresponding to the data signal, and a plurality of transistors that are configured to control the flow of a drive current.

The decoder 20 performs decoding to change compressed image data (DATA) to an original signal. Because the input image data (DATA) is generally compressed, the decoder 20 decodes the image data (DATA) so as to make an original image that may be regenerated. The image data (DATA) may be a multiplexed signal including an image signal, a voice signal, or a data signal. For example, the image data (DATA) may be a multiplexed MPEG-2 TS (Transport Stream) including an MPEG-2 standard image signal, a Dolby® AC-3 standard voice signal, etc.

The up-scaler 30 converts the decoded image data (DATA) so that it matches with the resolution or picture ratio of the display panel 10. For example, the up-scaler 30 may magnify the resolution or picture ratio of the image data (DATA). For example, in one embodiment, if the resolution of the input image data (DATA) is 1920×1080 and the resolution of the display panel 10 is 3200×1800, the up-scaler 30 increases the resolution by interpolating and inserting vertical and horizontal components of the image data (DATA). Further, if the picture ratio of the input image data (DATA) is 4:3 and the picture ratio of the display panel 10 is 16:9, the up-scaler 30 changes the picture ratio by interpolating and inserting vertical and horizontal components of the image data (DATA). Meanwhile, when the resolution and the picture ratio of the input image data (DATA) are identical with the resolution and the picture ratio of the display panel 10, the up-scaler 30 may bypass the image data (DATA).

The up-scaler 30 may selectively perform some of the processes that are done by the up-scaler 30 depending on a measured value input from the outside or the on/off state of the call mode. For example, the up-scaler 30 may perform a pattern identification process of analyzing image data, an interpolation process, a sharpness enhancement process, and other processes, and may combine different processes with each other to perform up-scale depending on the measured value. A more detailed description of the up-scaler 30 will be described with reference to FIG. 2.

The measured value may include at least one of an illumination measuring value IS measured by the illumination sensor 41, and/or an acceleration measuring value AS measured by the acceleration sensor 43. The illumination sensor 41 is provided on a side of the display panel 10 to sense the illumination of external light that is incident on the display panel 10. The acceleration sensor 43 may sense information about a moving speed or the image processing apparatus or the like. Each sensor transmits the sensed result to a separate sensing signal processing unit, or interprets the sensed result, and generates the measured value corresponding to the interpreted result, and provides the measured value to the up-scaler 30. The call mode unit 45 may give the on/off state of the call mode CM depending on a user input or the reception of a call to the up-scaler 30.

The frame rate converter (FRC) 50 may convert the frame rate of the input image data (DATA) from a first frame rate to a second frame rate. For example, the frame rate of 60 Hz is converted into 120 Hz or 240 Hz. When the frame rate of 60 Hz is converted into 120 Hz, the identical first frame or a third frame predicted from first and second frames may be inserted between the first and second frames. Meanwhile, when the frame rate of 60 Hz is converted into 240 Hz, it is possible to insert three identical frames or three predicted frames.

The timing control unit 60 receives the image data (DATA) and input control signals for controlling the display of the image data, for example, a horizontal synchronization signal Hsync, a vertical synchronization signal Vsync, and a clock signal CLK. The timing control unit 60 outputs image data (DATA'), which has gone through the above-mentioned decoder 20, up-scaler 30, and FRC 50 to be image processed, to the data drive unit 70. Further, the timing control unit 60 may generate and output a data control signal DCS that controls the driving of the data drive unit 70 based on the input control signals, and a gate control signal GCS that controls the driving of the gate drive unit 80.

The data drive unit 70 generates the data signal in response to the supplied image data (DATA') and data control signal DCS, and then supplies the data signal to the data lines DL. The data signal supplied to the data lines DL is supplied to the pixels selected by the gate signal whenever the gate signal is supplied.

The gate drive unit 80 generates the gate signals in response to the supplied gate drive voltage and the gate control signals GCS, and subsequently supplies the gate signals to the gate lines GL. Then, the pixels of the display panel 10 are selected row by row in response to the gate signals and are supplied with the data signals.

Figure 2:
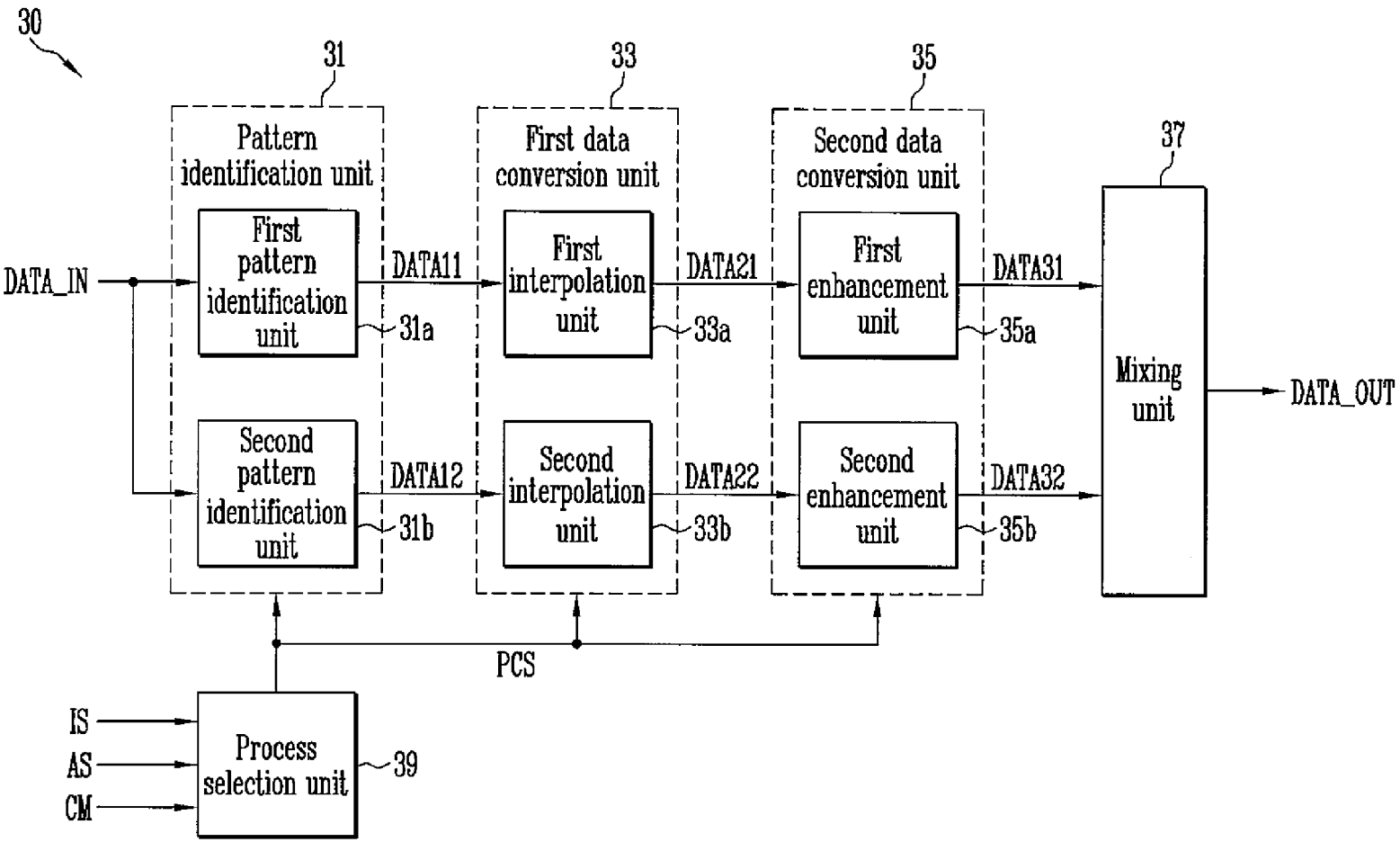
FIG. 2 is a view showing the detailed configuration of an up-scaler of FIG. 1.

FIG. 2 is a view showing more detail of the configuration of the up-scaler 30 of FIG. 1.

Referring to FIG. 2, the up-scaler 30 may include a pattern identification unit 31, a first data conversion unit 33, a second data conversion unit 35, a mixing unit 37, and a process selection unit 39.

The pattern identification unit 31 performs pattern identification for the input first image data (DATA_IN). The pattern identification unit 31 may include a first pattern identification unit 31*a* that identifies an edge pattern based on the first image data (DATA_IN), and a second pattern identification unit 31*b* that identifies a character pattern. For example, the first pattern identification unit 31*a* analyzes the first image data (DATA_IN) and identifies a range where the image characteristic value (grayscale level or color data) between adjacent pixels is abruptly reduced or increased, using the edge pattern. Further, the second pattern identification unit 31*b* identifies the character pattern using the following characteristics: a general image and a character pattern are different from each other in tendency of an image characteristic value of peripheral image data. The pattern identification unit 31 may use various methods to identify the image edge pattern and the character pattern.

The first data conversion unit 33 performs the first data conversion for first image data (DATA11, DATA12) whose pattern has been identified, thus generating second image data (DATA21, DATA22). In this regard, the first data conversion may be the interpolation process wherein the first image data (DATA11, DATA12) having the first resolution is interpolated to generate the second image data (DATA21, DATA22) having the second resolution that is higher than the first resolution. To this end, the first data conversion unit 33 may include a first interpolation unit 33*a* and a second interpolation unit 33*b* that perform the first data conversion using different algorithms corresponding to the edge pattern and the character pattern, respectively, identified by the pattern identification unit 31. For example, the first interpolation unit 33*a* interpolates the edge pattern of the image to generate a median value, while the second interpolation unit 33*b* interpolates the character pattern to generate a median value. In this regard, the interpolation algorithms of the first and second interpolation units 33*a* and 33*b* may utilize various known methods.

The second data conversion unit 35 performs the second data conversion for the second image data (DATA21, DATA22) that has undergone the first data conversion to generate third image data (DATA31, DATA32). Here, the second data conversion may be a sharpness enhancement process for enhancing the sharpness of the second image data (DATA21, DATA22) that is interpolated. To this end, the second data conversion unit 35 may include a first enhancement unit 35*a* and a second enhancement unit 35*b* that perform the second data conversion using different algorithms corresponding to the edge pattern and the character pattern, respectively. For example, the first enhancement unit 35*a* corrects the image characteristic value of the edge pattern of the image, thus increasing the sharpness, and the second enhancement unit 35*b* corrects the image characteristic value of the character pattern, thus increasing the sharpness. Accordingly, character legibility may be enhanced. The sharpness enhancement algorithm of the first and second enhancement units 35*a* and 35*b* may utilize various known methods.

The mixing unit 37 mixes third image data (DATA31, DATA32), thus outputting perfect image data (DATA_OUT) that constitutes one frame.

The process selection unit 39 previously determines the process to selectively perform some of the pattern identification, the first data conversion and the second data conversion, depending on the measured value input from the outside or the on/off state of the call mode. That is, the process selection unit 39 controls the pattern identification unit 31, the first data conversion unit 33, and the second data conversion unit 35 to selectively perform some of the processes of the up-scaler 30 according to various conditions. In this regard, the measured value may include at least one of the illumination measuring value IS and the acceleration measuring value AS. Further, the process selection unit 39 determines whether or not a current state is the call mode, based on the call mode on/off signal (CM).

For example, when the illumination measuring value IS is larger than a first reference value, the process selection unit 39 may output a process control signal PCS to perform only the first data conversion. That is, if external light incident on the display panel 10 is bright and thus visibility is low, the sharpness of the image and the legibility of the character may be lowered, so that the pattern identification process and the sharpness enhancement process may be excluded. However, because the interpolation process utilized for the up-scale may need to be conducted, the interpolation process for the image may be performed. The first reference value of the illumination measuring value IS may be preset using various experimental and statistical methods.

Further, if the acceleration measuring value AS is larger than a second reference value, the process selection unit 39 may output the process control signal PCS to perform only the pattern identification and the first data conversion. That is, because the visibility may be lowered if the display panel 10 is severely shaken, the sharpness enhancement process may be excluded. However, the interpolation process utilized for the up-scale is performed, and the pattern identification process and the interpolation process according to the pattern may be selectively conducted. The second reference value of the acceleration measuring value AS may be preset using various experimental and statistical methods.

Further, when the call mode CM is on, the process selection unit 39 may output the process control signal PCS to perform the first data conversion and the second data conversion corresponding to the character pattern. That is, because a simple dial pad UI may be primarily displayed in the case of the call mode CM, the image-edge-pattern identification process or the interpolation and the sharpness enhancement process may be excluded. Here, in addition to the call mode CM, a character mode, a text mode, etc. may be added.

The process selection unit 39 may analyze the measured value frame by frame and output the process control signal PCS. Further, the process selection unit 39 may not be located in the up-scaler 30, but instead may be located outside or externally with respect to the up-scaler 30 to control the up-scaler 30.

The up-scaler 30 may be changed in various structures that are controlled to selectively perform some of the processes of the up-scaler 30 depending on the circumstances, without being limited to the above-mentioned structure. Further, the up-scaler 30 may be changed such that the combination of various different processes is applied thereto depending on the illumination measuring value IS and the acceleration measuring value AS.

Figure 3:
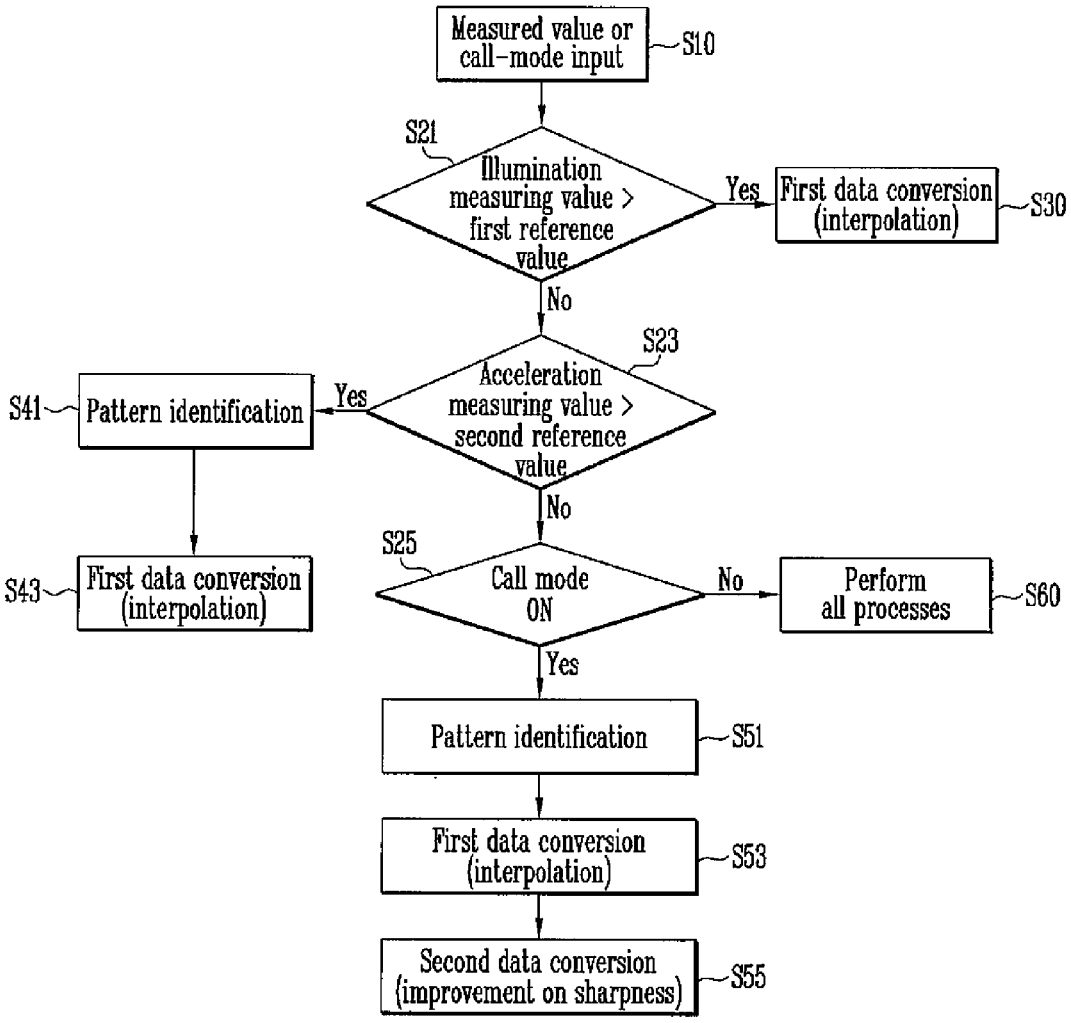
FIG. 3 is a flowchart showing an image processing method according to embodiments of the present invention.

FIG. 3 is a flowchart showing an image processing method according to some embodiments of the present invention.

Referring to FIG. 3, first, the up-scaler 30 receives the measured value and the call mode on/off signal CM, at block S10. In this context, the measured value may include at least one of the illumination measuring value IS sensed by the illumination sensor 41, and the acceleration measuring value AS sensed by the acceleration sensor 43.

The up-scaler 30 determines whether or not the input illumination measuring value IS is more than the first reference value, at block S21. If the illumination measuring value IS is more than the first reference value at block S21, the up-scaler 30 performs only the first data conversion at block S30. For example, the first interpolation unit 33*a* interpolates the edge pattern of the image, thus generating the median value. Other processes are excluded. That is, in the case where the external light incident on the display panel 10 is bright and thus visibility is low, the sharpness of the image and the legibility of the character are lowered, so that the pattern identification process and the sharpness enhancement process may be excluded. However, because the interpolation process utilized for the up-scale may be performed, the interpolation process for the image may also be conducted.

If the illumination measuring value IS is less than the first reference value at block S21, the up-scaler 30 determines whether or not the input acceleration measuring value AS is more than the second reference value at block S23. If the acceleration measuring value AS is more than the second reference value at block S23, the up-scaler 30 performs the pattern identification at block S41. Next, the up-scaler 30 performs the first data conversion at block S43.

For example, the first pattern identification unit 31*a* analyzes the first image data (DATA_IN) to identify the range where the image characteristic value (the grayscale level or color data) is abruptly reduced or increased between the adjacent pixels, using the edge pattern. Further, the second pattern identification unit 31*b* identifies the character pattern using the following characteristics: the general image and the character pattern are different from each other in tendency of the image characteristic value of peripheral image data. The first interpolation unit 33*a* interpolates the edge pattern of the image identified by the first pattern identification unit 31*a*, thus generating the median value, and the second interpolation unit 33*b* interpolates the character pattern identified by the second pattern identification unit 31*b*, thus generating the median value.

If the acceleration measuring value AS is less than the second reference value at block S23, the up-scaler 30 determines the on/off state of the call mode CM at block S25. If the call mode CM is on at block S25, the up-scaler 30 identifies the character pattern at step S51. Further, the first data conversion corresponding to the identified character pattern is performed at block S53. Next, the second data conversion is performed at block S55.

For example, the second pattern identification unit 31*b* identifies the character pattern using the following characteristics: the general image and the character pattern are different from each other in tendency of the image characteristic value of peripheral image data. The second interpolation unit 33*b* interpolates the character pattern identified by the second pattern identification unit 31*b*, thus generating the median value. The second enhancement unit 35*b* corrects the image characteristic value of the interpolated character pattern, thus increasing the sharpness.

If the call mode CM is off at block S25, all the up-scale processes are performed at block S60. That is, because the visibility is not lowered or the call is not made, each of the pattern identification process, the interpolation process, and the sharpness enhancement process are performed. Here, the order of the above-mentioned blocks S21, S23 and S25 is variable, and the combination of the processes may be changed depending on a given condition.

By way of summation and review, the up-scaler 30 analyzes the input image data and then performs different processes depending on a given condition such as the image pattern or character pattern. This may improve the quality of the generated image. However, as the process of analyzing or converting the image data is added, power consumption required for the process may be increased.

According to some embodiments of the present invention, depending on the measured value input from the outside or the on/off state of the call mode, the up-scaler 30 selectively performs some of the processes, thus reducing power consumption to process the up-scale image.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and their equivalents.

What is claimed is:

1. An image processing apparatus comprising:

a pattern identification unit configured to perform pattern identification for first image data;

a first data conversion unit configured to perform first data conversion for the first image data, after a pattern of the first image data is identified, to generate second image data;

a second data conversion unit configured to perform second data conversion for the second image data to generate third image data; and a process selection unit configured to determine whether or not to perform at least one of the pattern identification, the first data conversion, or the second data conversion according to a measured value that is input from an outside or an on/off state of a call mode, wherein the pattern identification unit comprises:

a first pattern identification unit configured to identify an edge pattern from the first image data; and a second pattern identification unit configured to identify a character pattern.

2. The image processing apparatus as claimed in claim 1, wherein the second image data has a higher resolution than that of the first image data.

3. The image processing apparatus as claimed in claim 1, wherein the first data conversion unit comprises a first interpolation unit configured to interpolate the first image data having a first resolution to generate the second image data having a second resolution that is higher than the first resolution.

4. The image processing apparatus as claimed in claim 1, wherein the third image data has a higher sharpness than that of the second image data.

5. The image processing apparatus as claimed in claim 1, wherein the measured value comprises at least one of an illumination measuring value sensed by an illumination sensor, or an acceleration measuring value sensed by an acceleration sensor.

6. The image processing apparatus as claimed in claim 1, wherein the first data conversion unit comprises:

first and second interpolation units configured to perform the first data conversion according to the edge pattern and the character pattern, respectively.

7. The image processing apparatus as claimed in claim 6, wherein the second data conversion unit comprises:

first and second enhancement units configured to perform the second data conversion according to the edge pattern and the character pattern, respectively.

8. The image processing apparatus as claimed in claim 7, wherein the process selection unit is configured to output a process control signal to perform the first data conversion and the second data conversion corresponding to the character pattern, when the call mode is on.

9. An image processing apparatus comprising:

a pattern identification unit configured to perform pattern identification for first image data;

a first data conversion unit configured to perform first data conversion for the first image data, after a pattern of the first image data is identified, to generate second image data;

a second data conversion unit configured to perform second data conversion for the second image data to generate third image data; and a process selection unit configured to determine whether or not to perform at least one of the pattern identification, the first data conversion, or the second data conversion according to a measured value that is input from an outside or an on/off state of a call mode, wherein the measured value comprises at least one of an illumination measuring value sensed by an illumination sensor, or an acceleration measuring value sensed by an acceleration sensor, and wherein the process selection unit is configured to output a process control signal to perform only the first data conversion, when the illumination measuring value is more than a first reference value.

10. The image processing apparatus as claimed in claim 9, wherein the process selection unit is configured to output the process control signal to perform only the pattern identification and the first data conversion, when the acceleration measuring value is more than a second reference value.

11. The image processing apparatus as claimed in claim 1, wherein the process selection unit is configured to analyze the measured value frame by frame and then output a process control signal.

12. An image processing method, comprising:

receiving, by a processor, a measured value input from the outside and an on/off state of a call mode; and determining, by the processor, according to the measured value input from the outside or the on/off state of the call mode, whether or not to:

identify a pattern for first image data by identifying an edge pattern or a character pattern from the first image data;

generate second image data by performing first data conversion for the first image data after the pattern for the first image data has been identified; and generate third image data by performing second data conversion for the second image data.

13. The image processing method as claimed in claim 12, wherein the measured value comprises at least one of an illumination measuring value sensed by an illumination sensor, or an acceleration measuring value sensed by an acceleration sensor.

14. The image processing method as claimed in claim 13, further comprising determining, by the processor, to perform only the generating of the second image data, when the illumination measuring value is more than a first reference value.

15. The image processing method as claimed in claim 14, further comprising determining, by the processor, to perform only the identifying of the pattern and the generating of the second image data, when the acceleration measuring value is more than a second reference value.

16. The image processing method as claimed in claim 15, further comprising determining, by the processor, to perform the identifying of the pattern, the generating of the second image data, and the generating of the third image data, when the call mode is on.

17. The image processing method as claimed in claim 12, further comprising analyzing, by the processor, the measured value frame by frame.

* * * * *